US006209663B1

(12) United States Patent
Hosie

(10) Patent No.: US 6,209,663 B1
(45) Date of Patent: Apr. 3, 2001

(54) UNDERBALANCED DRILL STRING DEPLOYMENT VALVE METHOD AND APPARATUS

(76) Inventor: David G. Hosie, 5918 Pendleton Place Dr., Sugar Land, TX (US) 77479

( * ) Notice: Subject to any disclaimer, the term of this patent is extended or adjusted under 35 U.S.C. 154(b) by 0 days.

(21) Appl. No.: 09/291,515

(22) Filed: Apr. 14, 1999

Related U.S. Application Data

(60) Provisional application No. 60/085,893, filed on May 18, 1998.

(51) Int. Cl.[7] ..... E21B 21/10; E21B 34/14

(52) U.S. Cl. ..... 175/57; 175/318; 166/332.8

(58) Field of Search ..... 166/332.1, 332.8, 166/319, 320, 321, 374, 375, 373, 84.3; 175/57, 317, 318

(56) References Cited

U.S. PATENT DOCUMENTS

| | | | | |
|---|---|---|---|---|
| 3,763,932 | * | 10/1973 | Dinning | 166/72 |
| 3,845,818 | * | 11/1974 | Deaton | 166/224 S |
| 4,597,445 | * | 7/1986 | Knox | 166/319 |
| 4,624,315 | * | 11/1986 | Dickson et al. | 166/375 |
| 4,749,043 | * | 6/1988 | Rodenberger | 166/321 |
| 4,817,723 | * | 4/1989 | Ringgenberg | 166/321 |
| 4,846,281 | * | 7/1989 | Clary et al. | 166/373 |
| 4,890,674 | * | 1/1990 | Le | 166/321 |
| 4,986,357 | * | 1/1991 | Pringle | 166/321 |
| 5,137,089 | * | 8/1992 | Smith et al. | 166/321 |
| 5,145,005 | | 9/1992 | Dollison . | |
| 5,199,494 | * | 4/1993 | Williamson, Jr. | 166/321 |
| 5,279,365 | * | 1/1994 | Yenulis et al. | 166/84 |
| 5,310,005 | | 5/1994 | Dollison . | |
| 5,411,096 | * | 5/1995 | Akkerman | 166/321 |
| 5,564,675 | * | 10/1996 | Hill, Jr. et al. | 166/321 |
| 5,588,491 | * | 12/1996 | Brugman et al. | 166/84.3 |
| 5,609,178 | * | 3/1997 | Hennig et al. | 166/319 |
| 5,662,181 | * | 9/1997 | Williams et al. | 175/195 |
| 5,848,643 | * | 12/1998 | Carbaugh et al. | 166/85.4 |
| 5,862,864 | * | 1/1999 | Whiteford | 166/332.8 |
| 5,890,540 | * | 4/1999 | Pia et al. | 166/321 |
| 6,016,880 | * | 1/2000 | Hall et al. | 175/195 |

* cited by examiner

*Primary Examiner*—Brian L. Johnson
*Assistant Examiner*—Joselynn Z. Sliteris
(74) *Attorney, Agent, or Firm*—Kenneth L. Nash

(57) ABSTRACT

Apparatus and methods for a deployment valve used with an underbalanced drilling system to enhance the advantages of underbalanced drilling. The underbalanced drilling system may typically comprise elements such as a rotating blow out preventer and drilling recovery system. The deployment valve is positioned in a tubular string, such as casing, at a well bore depth at or preferably substantially below the string light point of the drilling string. When the drilling string is above the string light point then the upwardly acting forces on the drilling string become greater than downwardly acting forces such that the drilling string begins to accelerate upwardly. The deployment valve has a bore sufficiently large to allow passage of the drill bit therethrough in the open position. The deployment valve may be closed when the drill string is pulled within the casing as may be necessary to service the drill string after drilling into a reservoir having a reservoir pressure. To allow the drill string to be removed from the casing, the pressure produced by the formation can be bled off and the drill string removed for servicing. The drill string can then be reinserted, the pressure in the casing above the deployment valve applied to preferably equalize pressure above and below the valve and the drill string run into the hole for further drilling.

37 Claims, 12 Drawing Sheets

UNDERBALANCED DRILL STRING DEPLOYMENT VALVE METHOD AND APPARATUS

This application claims the benefit of U.S. Provisional Application Ser. No. 60/085,893 filed May 18, 1998.

FIELD OF THE INVENTION

The present invention relates generally to underbalanced drilling and, more particularly, to a deployment valve method and apparatus for removing and inserting a drill string into a well bore when downhole pressures such as formation pressure are present at the surface to act on the drill string.

DESCRIPTION OF THE BACKGROUND

Underbalanced drilling has many advantages. In some cases, oil/gas well flow during underbalanced drilling of a well has been sufficient to pay for the cost of drilling the well even prior to completion of the well. Other advantages include that of avoiding formation damage for a better performing well and more accurate logging measurements of the well contents. For a discussion of advantages of underbalanced drilling including methods of controlling the well using an exemplary rotating blow out preventer, please refer to U.S. Provisional Application Ser. No. 60/083436, entitled ROTATING BOP AND METHOD, filed Apr. 29, 1998, to Hosie et. al, subsequently filed as U.S. patent application Ser. No. 09/178,006, filed Oct. 23, 1998, which applications are hereby incorporated herein by reference. Thus, there are numerous and significant advantages for underbalanced drilling of a well.

However, various problems exist for underbalanced drilling. These problems relate mainly to controlling the well in certain circumstances. A possible problem that may typically arise is the need to remove the drill string from the well. There are many common reasons that the drill string must be removed from the well prior to completion of drilling. It may be necessary to remove the drill string for reasons such as the need to change out the drill bit, steering tool, mud motor, and the like. Although pressure is controlled at the surface, such as with a rotating BOP, the weight of the drill string holds the drill string within the well bore. The string light point is the depth or position where the upward forces acting on the drill string become greater than the downward forces. Many factors are involved and may vary as to exactly where in a well the drill string becomes string light. Such factors include but are not necessarily limited to, or may not necessarily always include, the following: surface pressure, down hole pressure, flow rate, hole size, drill pipe size and weight, the amount of drill pipe in the hole, bit size, casing size, and fluid or gas properties. Generally assuming other factors remain constant, as the drill string is pulled further out of the hole, the downwardly acting forces decrease due to decreased drilling string weight.

If an attempt to remove the drill string is made with pressure at the surface, then at some point as the drill string is being removed the pressure may begin to push or accelerate the drill string out of the well bore. This is a dangerous situation that could conceivably lead to a blow out. Once the pipe begins to move upwardly there may be developed a significant momentum such that the blow out preventers may not be able to stop the upward movement. Once the heavy pipe string is moving upwardly, closing the rams may result in tearing the rams out rather than stopping the upward movement of the pipe. In this case, the rams will not be available to shut in the well after the pipe has been pushed from the well bore, assuming there is someone left at the rig site to activate the rams after the drill pipe is ejected from the well. The forces are great enough so that ejected drill pipe may be found quite far from the rig. As well, sparks produced can ignite gas to produce a hot fire that can melt a drilling rig within minutes. Blow outs can result in costly problems such as personnel injury, damage to the drilling rig, environmental damage, and loss of the hole. Presently, methods used to avoid a blow out situation are effective but have significant disadvantages.

While it may be possible to bleed off the surface pressure prior to reaching the point where the string becomes "string light" and begins to move upwardly, this practice is risky. For instance, a bridge in the bore hole may form in the formation that temporarily permits a bleed off to appear to occur. If the bridge should break at the wrong moment with the pipe nearly out of the hole, then significant formation pressure may be applied at the surface to result in a blow out.

A very effective and safe practice is to kill the well prior to removal of the drilling string. However, this practice is undesirable because the advantages of underbalanced drilling may then be lost. Once the drill string is lowered back into the well bore below the string light point it may be possible to adjust the drilling fluids so that underbalanced drilling continues. However, formation damage may have already occurred that is substantially or partially irreversible.

Another very effective and safe practice is that of providing a snubbing unit for removing the drilling string. However, the snubbing unit takes considerable time to rig up, requires considerable additional time while tripping the well, and then requires considerable additional time to rig down. Thus, the cost of tripping the drill string can be quite considerable due to the rig time costs and snubbing unit costs. Additional tripping of the well may also be necessary and again require the snubbing unit. This procedure then, while effective and safe, increases drilling costs considerably.

Consequently, an improved method and apparatus is desirable for removing drill string from a well bore that is drilled underbalanced. Such an improved method and apparatus should provide for quick, but safe, removal of the drill string from the well without the need to kill the well. The method and apparatus should be useful for repeated tripping of the drill string whenever necessary without significant time and cost increases. Those skilled in the art will appreciate the present invention that addresses these and other problems.

Figure 1:
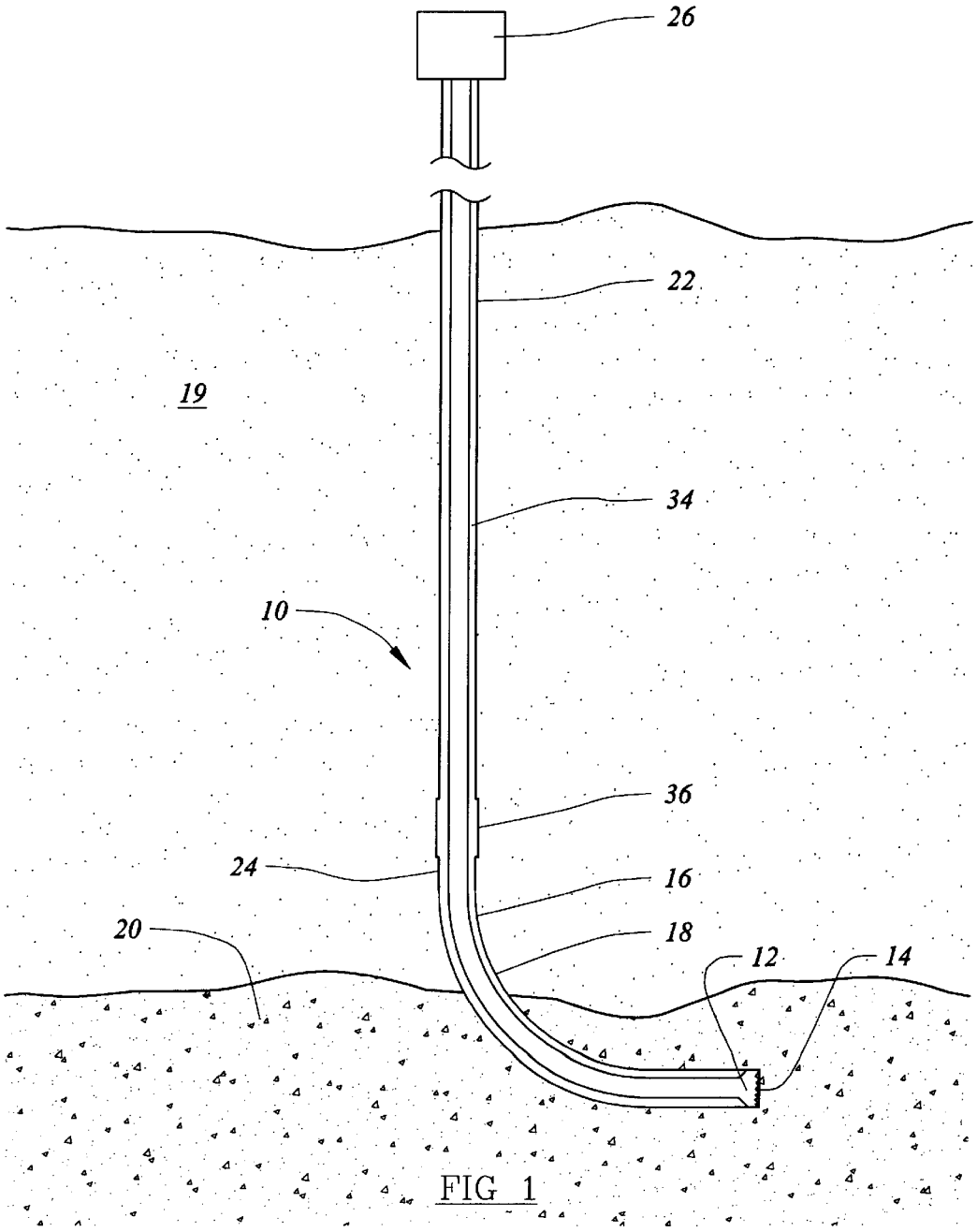
FIG. 1 is an elevational schematic view of an underbalanced wellbore operation wherein the drill string extends through an open deployment valve in the casing in accord with the present invention into the reservoir formation.

While the present invention is disclosed in terms of a presently preferred embodiment or embodiments in accordance with patent laws, it will be understood that the present invention is not intended to be limited to the particular embodiment or embodiments shown for permitting understanding of the invention. Instead, it is desired to cover all embodiments contained within the spirit of the invention.

SUMMARY OF THE INVENTION

The present invention provides a means for more quickly removing a drilling string from a tubular string, such as a tubular string of casing, when the tubular string is exposed to downhole pressure. This might occur after drilling through a reservoir formation with the drilling string. Attempts to remove the drilling string when downhole pressure is contained within the casing may be dangerous due to the possibility of a blowout.

A method for underbalanced drilling of a well bore through a well bore formation is provided herein wherein the well bore has a tubular string, such as a casing string secured therein. Typically but not necessarily, the casing string is cemented within the well bore at least over a certain length if not over substantially the entire length of the casing string. There may be multiple strings of casing within a well bore.

The method of the present invention comprises mounting a deployment valve within or as part of a tubular string, typically the casing string, preferably adjacent the reservoir formation. However, the deployment valve should preferably be below, preferably with a good safety margin, the string light position at which point the forces acting upwardly on the drilling string are greater than the forces acting downwardly such that the drilling string may begin to move upwardly. In one embodiment, the deployment valve has an open and a closed position. The tubular string is secured within the well bore, such as by cementing or other means, such that the deployment valve is mounted within. The deployment valve may be secured to the casing and run therewith or it may be mounted within the casing such as by running a smaller tubular string, lowering, wireline methods, or other methods. A drill string is provided to be operable for drilling into the reservoir portion of the well bore formation below the tubular string. The drill string is moveable through the tubular string or casing and the deployment valve when the deployment valve is in the open position. The deployment valve may be closed when the drill string is no longer positioned within the deployment valve.

The drill string may be extended through the deployment valve to drill below the casing such as into the reservoir portion of the well bore formation below the tubular string. The drill string may be pulled from the reservoir portion into the tubular string, and the deployment valve closed once the last of the drill string is pulled therethrough. For this reason, it is typically desirable that the deployment valve be as close to the bottom of the casing as possible so that the deployment may be closed as soon as possible. At a minimum, the deployment valve should be located below the string light point as best determinable plus additional safety margin depth. The exact string light point may not be precisely known and could even vary. Once the drilling string is back within the casing or tubular string, it is desirable to reduce pressure in the tubular string above the deployment valve. Once reservoir pressure is bled off from the portion of the casing above the deployment valve, the drill string can be safely removed from the well bore. After the desired service is made to the drill string, the drill string may once again be introduced into the tubular string when the deployment valve is closed.

The casing may then be pressurized above the deployment valve to preferably equalize pressures above and below the valve. The deployment valve can then be opened to thereby extend the drill string through the deployment valve for continued drilling after servicing the drill string in some way.

A deployment valve system is provided for a drilling system to form a well bore through a well bore formation with the drilling string. The drilling string has a drill bit and the drill bit having an outer diameter. A deployment valve is positionable in the tubular string at a selected depth within the well bore formation preferably within the lower portion of the tubular string as discussed above. The deployment valve should be able to open such that the inner diameter is large enough to allow the drill bit to pass therethrough. While flexible sealing elements, such as expandable tubulars or bags could form portions of the valve, the valve could also take other forms as discussed below. In some embodiments of the present invention, the deployment valve body may have a bore therethrough having an inner diameter larger than the outer diameter of the drill bit. A deployment valve element is mounted within the deployment valve body for movement between an open position and a closed position. A seal surface for the deployment valve may also be provided. With the deployment valve element in the open position within the deployment valve body, the drill bit may pass through the valve. The deployment valve may be closeable with the seal surface for containing/controlling the formation reservoir pressure below the deployment valve. A rotating blowout preventer is provided for sealing around the drilling string at the surface.

Several options are available for the type of deployment valve used. The valve may be inflatable as by hydraulic control. The deployment valve element may include one or more flapper valve elements moveable within the deployment valve. One or more pivot connections may then be used to secure the one or more flapper valve elements to the deployment valve such that the one or more flapper valve elements are moveable between the open position and the closed position. The deployment valve could also be a ball valve or have another rotatable type of closure element. Telescoping elements may be used. Thus, the valve could be of many different constructions. The deployment valve may be hydraulically operated and have at least one hydraulic line for controlling movement of the deployment valve element. A biasing element(s), such as springs or weights, or other control lines may be used in conjunction therewith the above or subsequently described deployment valves. The deployment valve could also be annularly controlled such that an annulus is provided so that pressure acting thereon activates an annular control system to control the valve. Some type of combination of annular, hydraulic, biasing means, or other control method may be used.

The method for underbalanced drilling of a well bore through a reservoir formation with a drilling string operable for drilling into open hole at a well bore depth below the tubular string may also comprise positioning a deployment valve within the tubular string as described hereinbefore and below the string light position. The drilling string is moved through the tubular string and the deployment valve for drilling open hole below the tubular string. For various reasons, the drilling string may require being pulled back into the tubular from the open hole, whereupon the deployment valve is closed to thereby control pressure of the reservoir formation at a well depth below the deployment valve. The reservoir formation pressure within the tubular string at a well depth above the deployment valve is bled off. The tubular string is opened to atmospheric pressure and the drilling string is removed from the tubular string. At a later time, the drilling string may be reinserted into the tubular string.

An object of the present invention is to provide an improved method for underbalanced drilling.

Another object of the present invention is to provide a method for removing the drilling string from the well bore when the formation pressure acts on the well bore as occurs during underbalanced drilling.

Another object of the present invention is to provide a lower cost and faster method of removing the drill string from the bore hole for underbalanced drilling.

A feature of the present invention is a deployment valve preferably positioned below where the drill string becomes string light.

An advantage of the present invention is reduced costs and greater flexibility of an underbalanced drilling operation.

The above objects, features, and advantages are provided for easy review of some aspects of the invention and are not to be construed as limiting the invention in any way. It will be appreciated that other objects, features, and advantages of the present invention will become apparent in light of the drawings, claims and specification.

BRIEF DESCRIPTION OF THE PREFERRED EMBODIMENTS

The present invention represents a significant improvement in underbalanced drilling techniques and apparatus that addresses the potentially hazardous and/or costly problem of removing and reinserting a string of pipe such as the drill string from a live well.

Figure 2:
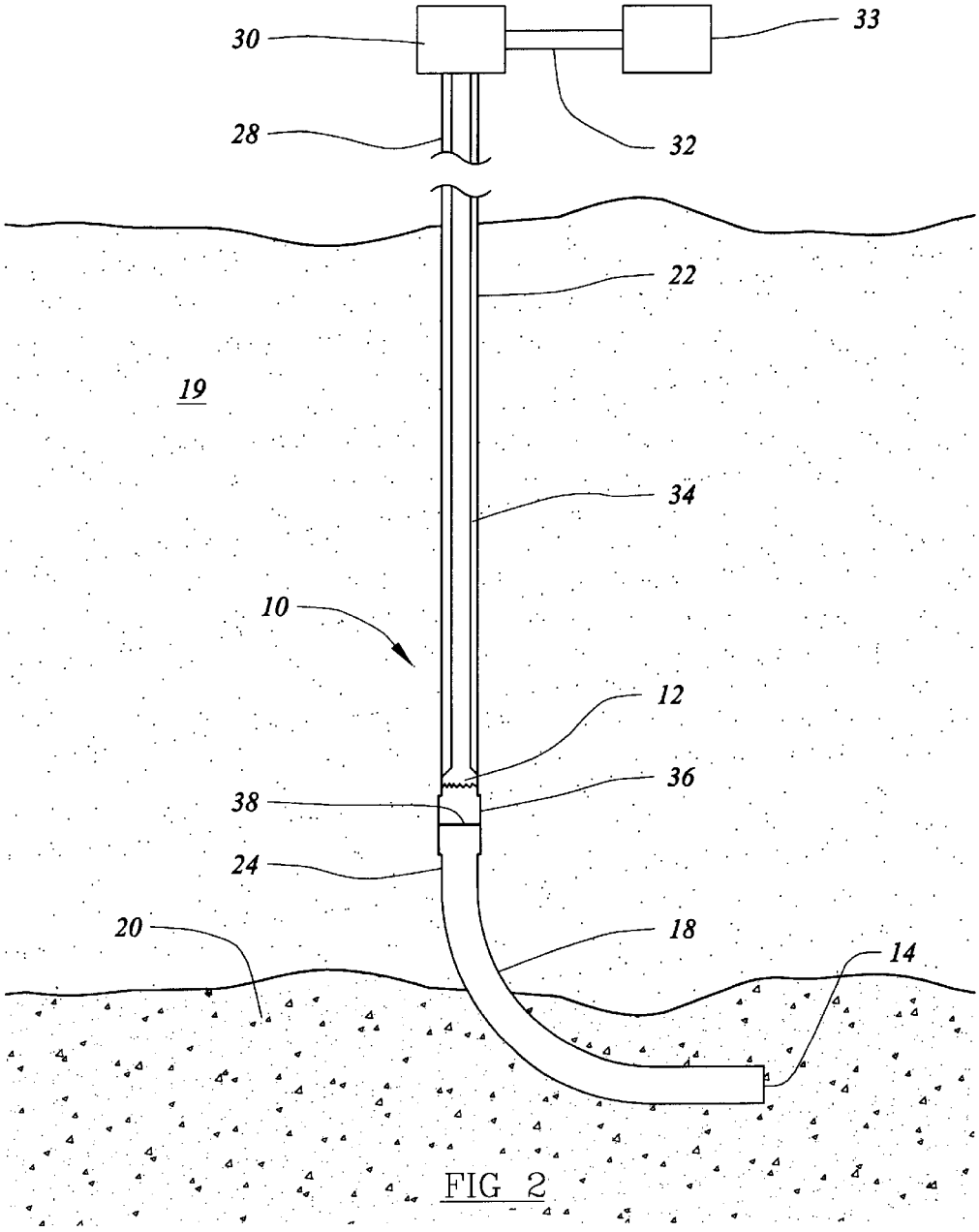
FIG. 2 is an elevational schematic view of removal of the drill string from the well bore into the casing whereupon the deployment valve is closed.

Referring now to the drawings, and more particularly to FIG. 1, there is shown a schematic that illustrates basic elements of the method and apparatus of the present system 10 of the invention. In FIG. 1, drill bit 12 is shown at the bottom 14 of well bore 18 and is drilling in open hole region 16. Drilling extends through well bore formation 19 into reservoir formation 20 below bottom 24 or shoe of casing 22. The well is being drilled underbalanced so that downhole pressure, which can be quite substantial, may reach or flow towards the upper portion of the hole. The pressure may be controlled at the surface by various wellbore controls, such as wellbore control 26. Wellbore control 26 may include a well head 28 with a rotating blow out preventer 30, flow line 32 and pressurized recovery system 33 as indicated in FIG. 2. Gas may be flared off, solids removed, oil and diesel separated off by a well bore control system such as a drilling recovery system with components such as pressure tanks, inlet manifold skid, pump skid, data acquisition, flow line, ESD valve, electrical generator, flare stack, glycol heater, heat tracing, triplex pump, and the like. The rotating blow out preventer, such as rotating blow out preventer 30, seals around the pipe as it moves into and out of the well bore. Details of an exemplary rotating blow out preventer are described in the application referenced above to Hosie et al. that is incorporated herein by reference. So long as there is no need to remove the drill pipe, the operation can proceed by simply adding drill pipe in drill string 34 as necessary to drill deeper as indicated in FIG. 1.

However, at some time it may become necessary to remove drill string 34 as indicated in FIG. 2 where deployment valve 36 is open to allow drill string 34 to move therethrough. When this occurs drill string 34 is pulled up into an outer tubular string, that may typically be casing string 22, and may include one or more strings of casing. Once drill string 34 is in the casing string 22 as indicated in FIG. 2, deployment valve 36 closes with seal element 38 to seal off the formation pressure below deployment valve 36. Drill string 34 can be moved upwardly to within a safe margin of it becoming string light. The pressure above deployment valve 36 can then be bled off. In fact, the casing above deployment valve 36 may be bled off at anytime after deployment valve 36 is closed. Once the pressure is bled off above deployment valve 36, then drill string 34 can be safely and quickly removed.

After the desired changes or repairs to drill string 34 are made, then drill string 34 can be run back into the hole to a desired depth which may be preferably near deployment valve 36 and below the string light position. When the drill string is above the string light point, the remaining pipe in the hole is not heavy enough to hold drill string 34 in the hole and the pipe may therefore be blown out of the hole, i.e., the upwardly forces acting on drill string 34 are greater than the downwardly forces acting on the drill string 34.

At some point after going below the string light position of the drill pipe when running the drill string back into the hole, casing 22 is preferably pressurized prior to opening the deployment valve 36. This is done so as to substantially equalize pressure above and below deployment valve 36. Deployment valve 36 is then opened, whereupon drill string 34 may be extended through deployment valve 36, out of the casing string 22, and back into formation 20 for continued drilling.

As discussed in the above referenced patent application, damage to the formation is averted because the pressure and fluids of the formation are contained therein as during drilling. It is not necessary to introduce additional pressure, fluids, or materials into the reservoir formation so as to force drilling fluid, cakes or filtrates thereof into the producing formation.

Deployment valve 36 may be run within casing 22 so as to be positioned surrounded by the well formation, such as near bottom end 24 of the casing. At a minimum, the position of deployment valve 36 should be below the anticipated string light point below which pipe string 34 will not be ejected from the well and preferably at a depth having a good margin of safety with respect to this position. Well bore depth may or may not be the same as vertical depth so that references to depths in the well bore such as above or below certain depths generally refer to well bore depths rather than vertical depths.

In some cases, well bore 18 may be considerably larger than the casing so that the diameter of deployment valve body 40 may be of larger diameter than that of casing 22. If the deployment valve body is smaller than the diameter of casing 22 or is collapsible so as to temporarily assume a smaller diameter, then deployment valve 36 may be positioned after casing 22, or one or more of the casing strings are in place, by some conveyance means such as wireline or tubing.

Figure 3:
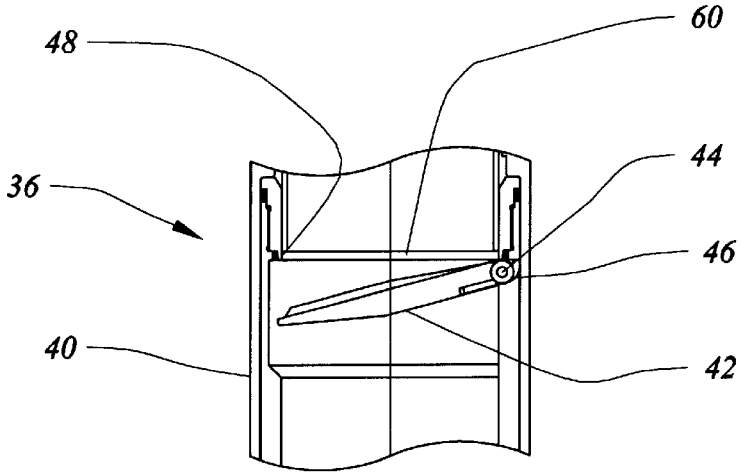
FIG. 3 is a schematic view of a deployment valve of a flapper valve type.

Deployment valve body 40 may have a flapper valve element 42, or other type of valve closure element mounted therein. As indicated in FIG. 3, flapper valve element 42, with hinge or pivot joint 44, may be provided with spring control 46 or weight operated to bias close and seal against seat 48. The weight of the drill string, and pressure above the flapper valve may be used to open flapper valve element 42. Deployment valve 36 may be self-closing by spring and/or weight and/or seal with the valve seat due to the force of pressure below deployment valve 36.

Figure 4:
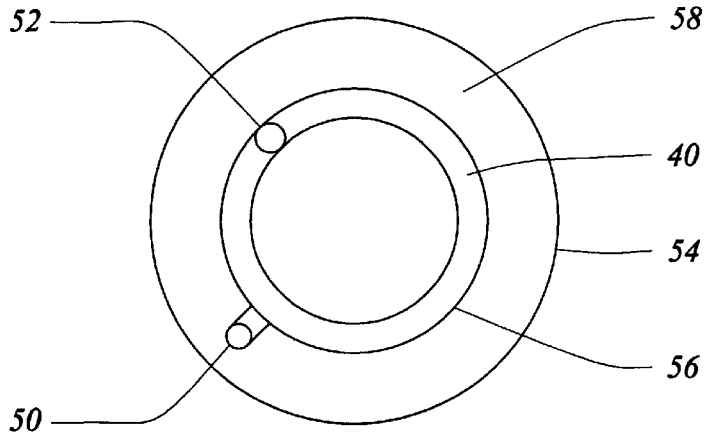
FIG. 4 is a schematic sectional view of a deployment valve that may be operated by annulus pressure and/or hydraulic lines.

Deployment valve 36 could also be controlled by control lines such as hydraulic control lines 50 or 52 or annular pressure control through annulus 58 between outer string 54 and inner string 56 as indicated in FIG. 4. Thus, the valve may also be a ball type of valve or other design as desired for the well conditions. Bias means, annular pressure, mechanical control, hydraulic control, other means may be used in conjunction with or used for control over the deployment valve. Valve body 40 may be inflatable or it may be comprised of a substantially inflexible material such as metal or composite materials. There may be several strings of casing in the hole whereby a portion of the valve may extend outwardly within an annulus between two strings of casing.

Opening diameter 60 of the valve should be sufficient to allow the drill string, including the drill bit to pass therethrough. Thus, the outer diameter of the drill bit should be smaller than the inner diameter of the deployment valve bore for some types of valve elements such as a flapper valve or ball valve. The valve element(s) should expand to allow the drill bit to pass if the valve elements are expandable or flexible. Deployment valve 36 may also be operated through interaction with the drill string or a drill string sub thereof such that vertical or rotational movement of the drill string controls deployment valve operation. More than one deployment valve may be used and if different deployment valves are used, they may be operated differently. As well, other types of valves and closure means may be used. Some leakage may be tolerable with the seal or sealing surfaces of the deployment valve so long as the leakage permits removal of the drill string. Temporary chemical plugs such as gels, cements, or the like may conceivably be used above the deployment valve. However, such uses may prevent the desirable possibility of repeated uses of the deployment valve.

A presently preferred embodiment of the deployment valve is shown in more detail in FIG. 5–FIG. 13.

Figure 5:
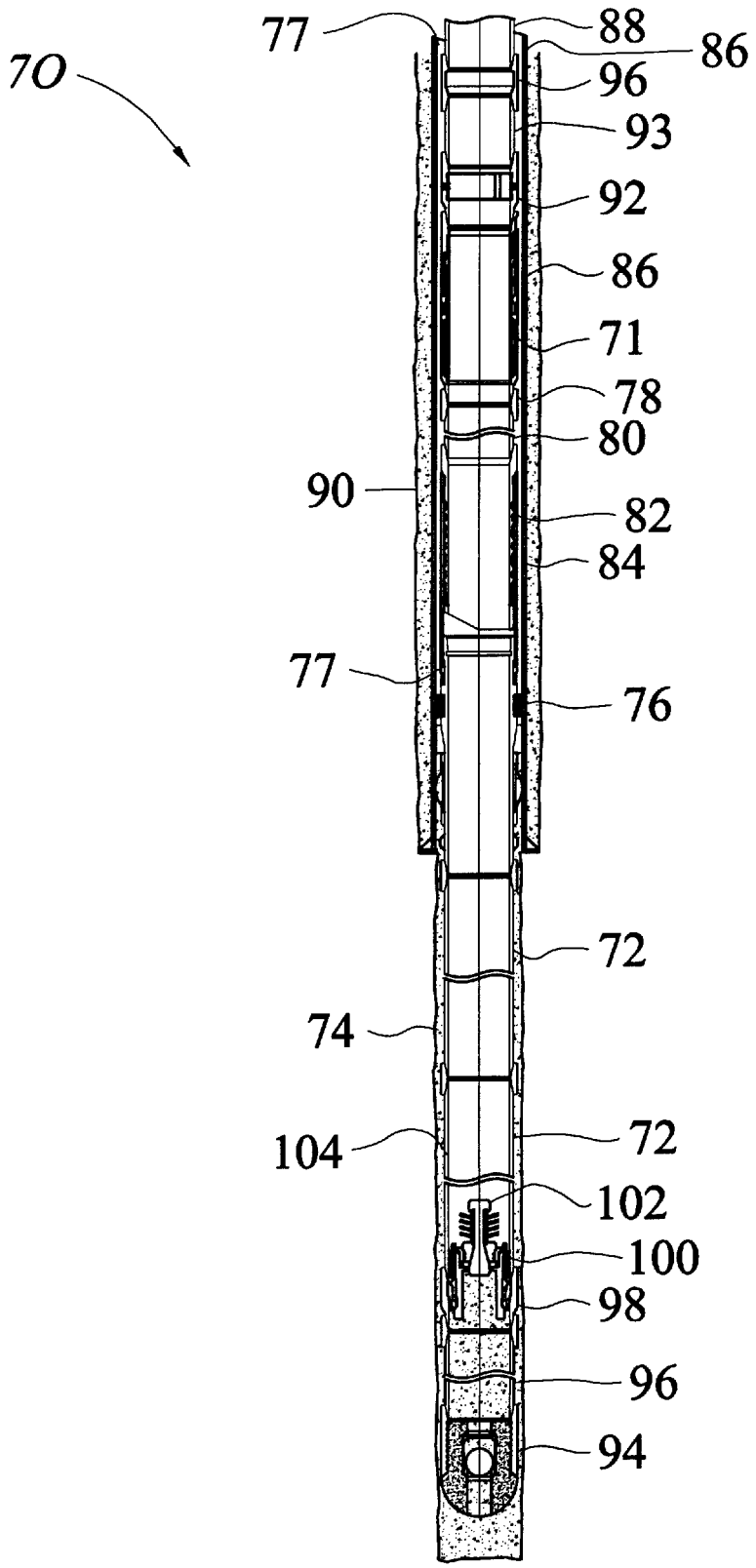
FIG. 5 is an elevational view, in section, of an annulus operated deployment valve positioned in a liner that is cemented within the borehole.

In FIG. 5, annular operation installation 70 shows deployment valve 71 installed in casing string 88/liner 72 for annular operation as discussed hereinafter. Liner 72 is effectively an extension of intermediate casing string 88 that goes to surface and deployment valve 71 is mounted therebetween so that deployment valve 71 is mounted within a tubular string that is partially cemented in position for installation 70. It will be understood that depending on numerous factors such as the well program, components in the well such as additional casing strings, and the like, that many variations of annular installation operation 70 may be used. Thus, FIG. 5 is a representative basic example of how deployment valve would be installed and it will be understood that numerous factors go into each well installation such that additional components could be added/deleted from casing string 88/liner 72. Liner 72 has been cemented into the borehole as indicated by cement 74 positioned outside liner 72. Liner hanger packer 76 is positioned below deployment valve 71. Liner hanger packer 76 prevents cement 74 from proceeding upwardly within annulus 77 past liner hanger 76 during the cementing process. For this purpose, liner hanger packer 76, or other packer means, is set or inflated prior to cementing to prevent cement from migrating into annulus 77. Thus, annulus 77 that is around deployment valve 71 is available for use in controlling deployment valve 71 by applying pressure to annulus 77 at the surface. Annulus 77 is formed between liner 72/casing string 88 and surface casing 86. Moreover, deployment valve 71 is surrounded by surface casing 86. Surface casing 86 is cemented into position as indicated by surface casing cement 90. Surface casing 86 extends to the surface. Pressure applied to annulus 77 operates to open and close deployment valve 71 in a manner discussed hereinafter.

In installation 70, between liner hanger packer 76 and deployment valve 71 are several components including casing coupling 78, joint of casing 80, tie back seal assembly 82, and tie back receptacle 84. Thus, annulus 77 extends downwardly past deployment valve 71 for some distance as might be advantageous for washing out annulus 77 as may be desired using, for instance, rotating port collar 92 or other components in the installation through which circulation may be established. It will be noted that positioned above deployment valve 71 is rotating port collar 92, spacing nipple 93, and locating nipple 96 that is secured to intermediate casing to surface 88. As can be seen, the point of development in the well as per FIG. 5 is just after cementing of the liner prior to drilling out of cement float shoe 94. Above float shoe 94 is joint of casing 96, plug landing collar 98, liner wiper plug 100, and drill pipe wiper plug 102.

The drill bit is normally only slightly smaller than the inner diameter 104 of liner 72. For instance, a 7-inch liner having 7-inch connections and with an outer diameter in the range of about seven inches might have a 6-inch inner diameter, in which case the drill bit is typically in the range of 5¾ to 5⅞ inches. Thus, deployment valve 71 opens full bore or, in other words, widely enough to allow a standard bit therethrough. The inner diameter of deployment valve 71 is therefore preferably at least as large as inner diameter 104 of liner 72 or other relevant wellbore tubulars or casing strings through which drilling is effected, and may in some cases be slightly larger. Moreover, the outer diameter of deployment valve is small enough to fit in the next standard size casing string in that it is less than about 10% greater in O.D. than the size casing upon which it is installed since well bores typically have multiple casing strings therein. Thus, there is no need to have an oversized outer casing in which to use the deployment valve. This percentage may vary depending on whether the casing is heavy weight or light weight and may typically be in the range from about 5% to about 10% greater that the casing size O.D.

Figure 6:
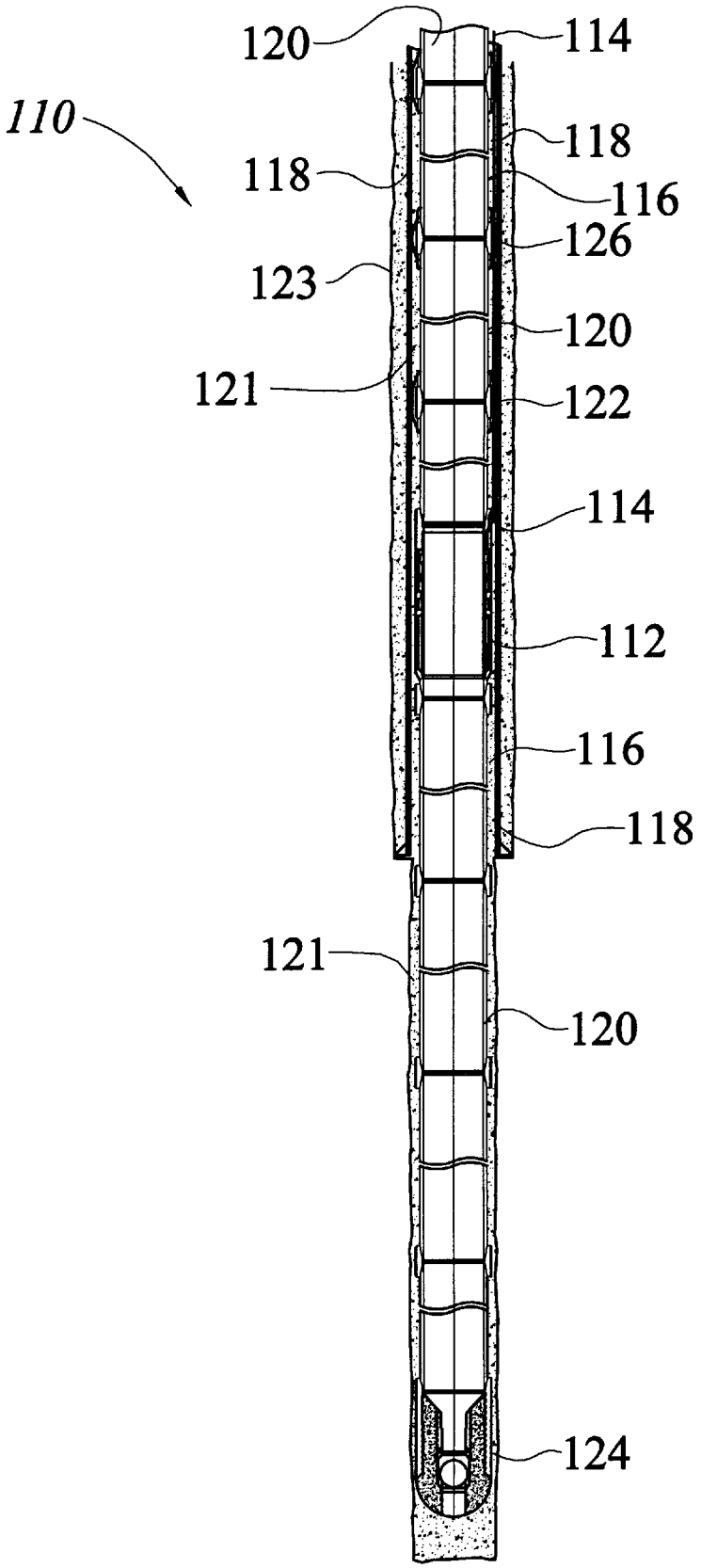
FIG. 6 is an elevational view, in section, of a control line operated deployment valve positioned in a liner that is cemented within the borehole.

In FIG. 6, installation 110 is shown whereby deployment valve 112 is operated by control line 114 that goes to surface. Unlike installation 70, in installation 110 annulus 116 between surface casing 118 and intermediate casing string 120 is filled with cement 121 during the cementing operation. In this way, control line 114 is rigidly secured in place. Surface casing 118 is also typically cemented in position (during a previous cement operation) as indicated by cement 123 outside of surface casing 118. Protectors such as control line coupling protector 122 may be used to protect control line 114 intermediate casing string 120 is positioned within surface casing 118. Casing 120 is centralized within surface casing 118 by centralizers such as casing centralizer 126. After cementing, float shoe 124 will be drilled out as drilling proceeds.

Figure 7:
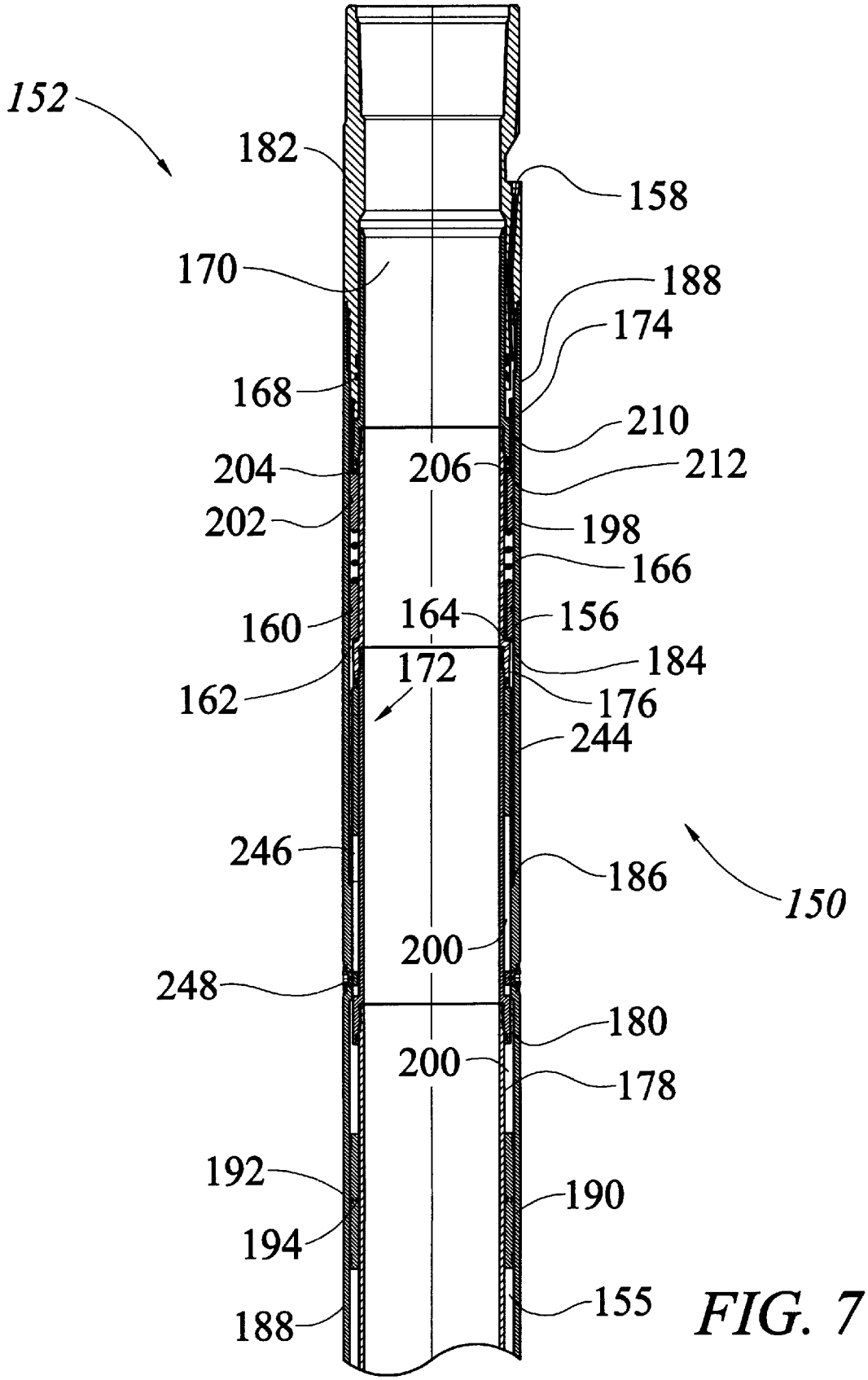
FIG. 7 is an schematic view of an upper section of a deployment valve in accord with the present invention.
Figure 8:
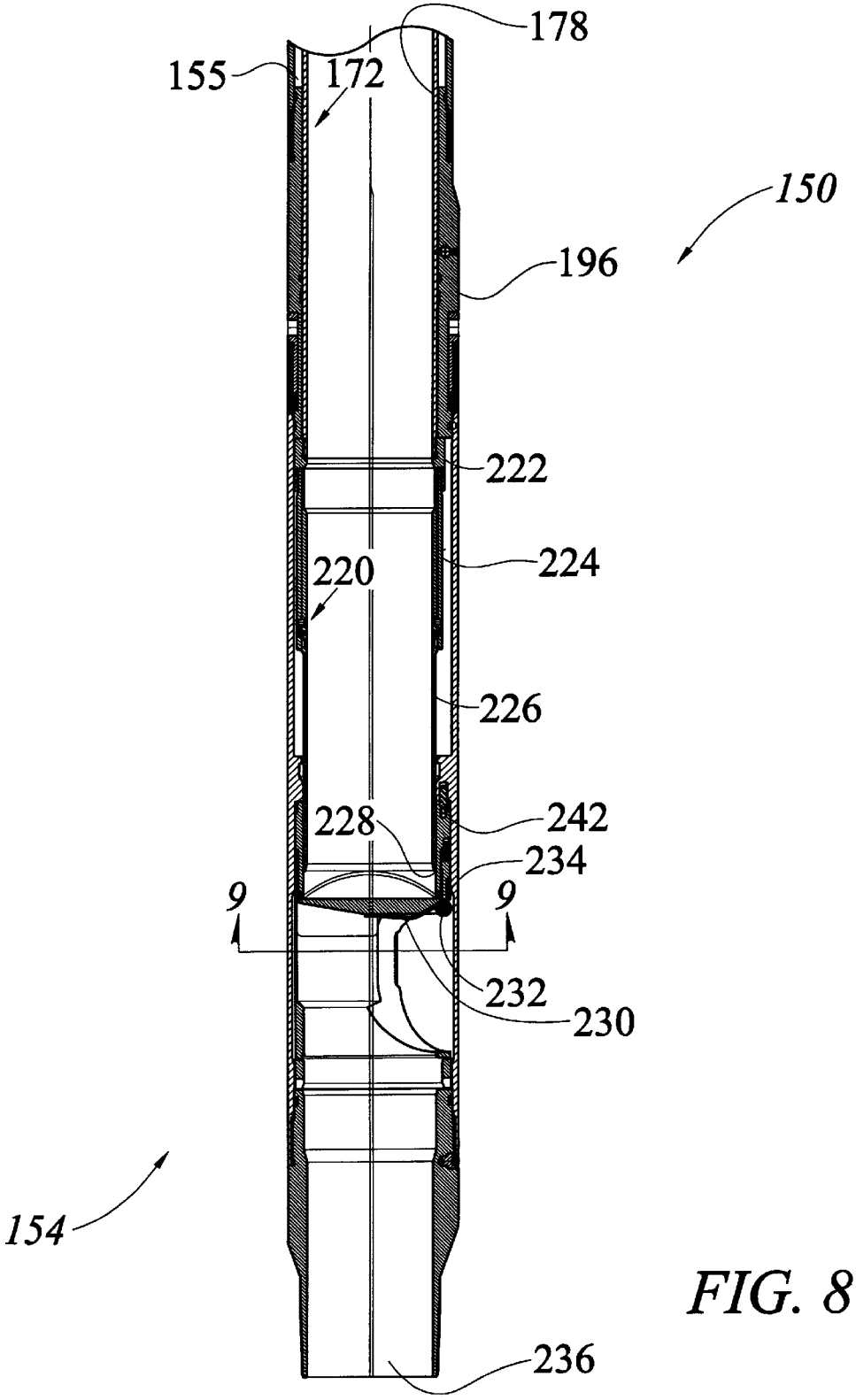
FIG. 8 is an elevational view, in section, of a lower section of a deployment valve in accord with the present invention.

In FIG. 7 and FIG. 8, deployment valve 150 is shown in two halves with actuator section 152 being shown in FIG. 7 and valve section 154 being shown in FIG. 8. Actuator section 152 sits above valve section 154 and is used to actuate an inner slidable mandrel that is upwardly and downwardly moveable for opening and closing the flapper valve in a manner to be explained.

Prior to running into the borehole, nitrogen chamber 155 is precharged to a selected percentage of hydrostatic pressure as determined for the most efficient opening and closing pressures. A typical value might be about 60% of the anticipated hydrostatic pressure in the borehole where deployment valve 150 will be positioned. After charging, deployment valve 150 is run into the hole with the casing string. As the depth of the deployment valve increases, the increasing hydrostatic pressure acts on lower equalizing valve piston 156. The hydrostatic pressure enters passage 158 which may be open to the annulus or connected to a control line.

Hydrostatic pressure acts on seal 160 and 162 of lower equalizing valve piston 156 creating a downward force on lower equalizing valve piston 156. Seal 162 is preferably positioned on shoulder 164 of upper mandrel 172 for reasons to be discussed. Spring 166 biases lower equalizing valve piston 156 against shoulder 164 and seal 162 for initial sealing therebetween. Seal 168 prevents hydrostatic pressure entering bore 170.

Due to increasing hydrostatic pressure, lower equalizing valve piston 156 pushes against shoulder 164 on the essentially one-piece upper mandrel 172. Upper mandrel 172 is comprised of upper seal mandrel 174, equalizing seal mandrel 176, J-slot mandrel 180 and nitrogen chamber mandrel 178 screwed or otherwise connected together as a onepiece slidable mandrel 172. Thus, upper mandrel 172 is forced downwardly relative to top body 182 of deployment valve in the direction of valve section 154 as indicated in FIG. 8 although it will be understood actual borehole orientations may vary considerably. For instance, deployment valve 150 may be used in horizontal wells and may be positioned at all borehole angles because it will be readily understood that tool orientation is dependent upon the borehole orientation direction in which the deployment valve is used. So the terms "up", "down", and the like are used for explanatory purposes and do not necessarily refer the position of the deployment valve in operation in the borehole. Upper mandrel 172 continues to move due to increasing hydrostatic force on lower equalizing valve piston 156 until lower face 184 of lower equalizing valve piston 156 comes into contact with shoulder 186 of housing 188. The increasing hydrostatic pressure causes seal 162 with lower face 184 of lower equalizing valve piston to be broken as pressure acts to move upper mandrel 172 slightly until leakage may occur past seal 162 so that the hydrostatic pressure now engages nitrogen piston 190. Any further movement of upper mandrel 172 after seal 162 with lower face 184 is broken tends to be very slight. Even a small opening provides enough space to permit pressurized flow past the broken seal to transmit the pressure to nitrogen piston 190. Therefore, increasing hydrostatic pressure now begins to act on nitrogen piston 190 between nitrogen piston seals 192 and 194 and moves nitrogen piston 190 downwardly or away from top body 182. Movement of nitrogen piston 190 reduces the volume of nitrogen chamber 155, thereby increasing the pressure of the nitrogen therein. Nitrogen chamber 155 is comprised of housing 188, nitrogen chamber mandrel 178, nitrogen piston 190, and center coupler 196 (shown in FIG. 8). Hydrostatic pressure continues to act on nitrogen piston 190 to move it further downwardly until nitrogen pressure equals hydrostatic pressure. Note that the above and continuing discussion is useful for describing how increasing/decreasing pressure can be used for operating deployment valve 150 in that the action of moving upper mandrel 172 also opens and closes deployment valve 150 as will be discussed subsequently. In some cases, this may not necessarily be the process of how the deployment valve will be run into the hole. For instance, in some cases it may be desirable to operate the valve on the surface to leave the valve in the open position while going in the hole in a manner as explained subsequently.

As an example of actuator section basic operation of moving upper mandrel 172 upwardly or in the opposite direction, additional pressure is applied to hydrostatic pressure either by annulus or control line. This further moves piston 190 downwardly increasing the nitrogen pressure above hydrostatic. The applied pressure is then reduced, though perhaps not to zero. Now the nitrogen pressure is greater than hydrostatic and any remaining surface applied pressure. Therefore, piston 190 moves upwardly due to the nitrogen pressure. Piston 190 applies a force on volume 200 of fluid between piston 190 and upper equalizing valve piston 198. This force creates a pressure in volume 200 which is greater than hydrostatic pressure and any remaining surface applied pressure. The pressure acts on upper equalizing valve piston 198 between seals 202 and 204. Upper face 206 of upper equalizing valve piston 198 acts on seal 204 that is mounted on shoulder 208 of upper seal mandrel 174. Therefore, upper equalizing valve piston 198 pushes upper seal mandrel 174 upwardly or toward top body 182 until upper equalizing valve piston 198 contacts the lower edge 212 of equalizing spacer 210 whereupon upper equalizing valve piston 198 can move no further upwardly. Along with upper equalizing valve piston 198, upper seal mandrel 174 and upper mandrel 172 are also forced upwardly as upper face 206 presses on shoulder 208 of upper seal mandrel 174. Once upper equalizing valve piston 198 contacts lower edge 212 of equalizing spacer 210, upper face 206 is separated from shoulder 208 and seal 204 so that seal 204 with upper face 206 is broken. The nitrogen pressure continues to operate on nitrogen piston 190 to move upwardly until pressure bleeds off in volume 200 past seal 204. Any Page 17 of 30 Pages movement of upper mandrel 172 relative to upper equalizing valve piston 198 after seal 204 is broken tends to be very slight. As explained above, seal 204 was broken because upper equalizing valve piston 198 stops movement when upper face 206 thereon engages lower edge 212 but upper seal mandrel 174 continues to move slightly to open or break the seal therebetween. The end result is that nitrogen pressure is now charged to the same pressure as they hydrostatic pressure. Further operation of deployment valve is conducted by repeating the process, essentially, of applying pressure to open the valve and reducing pressure to close the valve. Some additional factors apply such as the indexing function that is explained hereinafter. The use of the nitrogen piston allows use of a single control line and/or use of hydrostatic control because the nitrogen piston provides a return force for closing the valve so that only an opening force need be applied from the surface.

Figure 9:
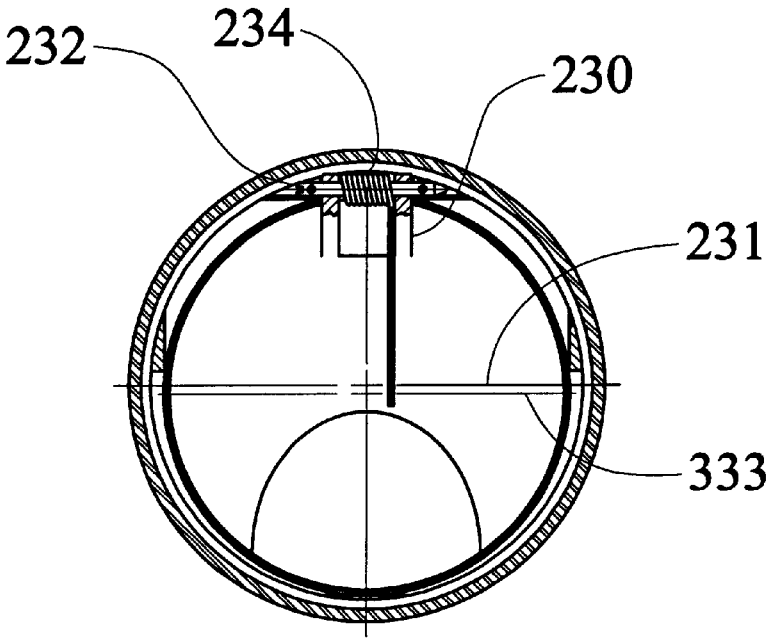
FIG. 9 is a cross-sectional view, in section, taken along lines 9—9 of FIG. 8.
Figure 10:
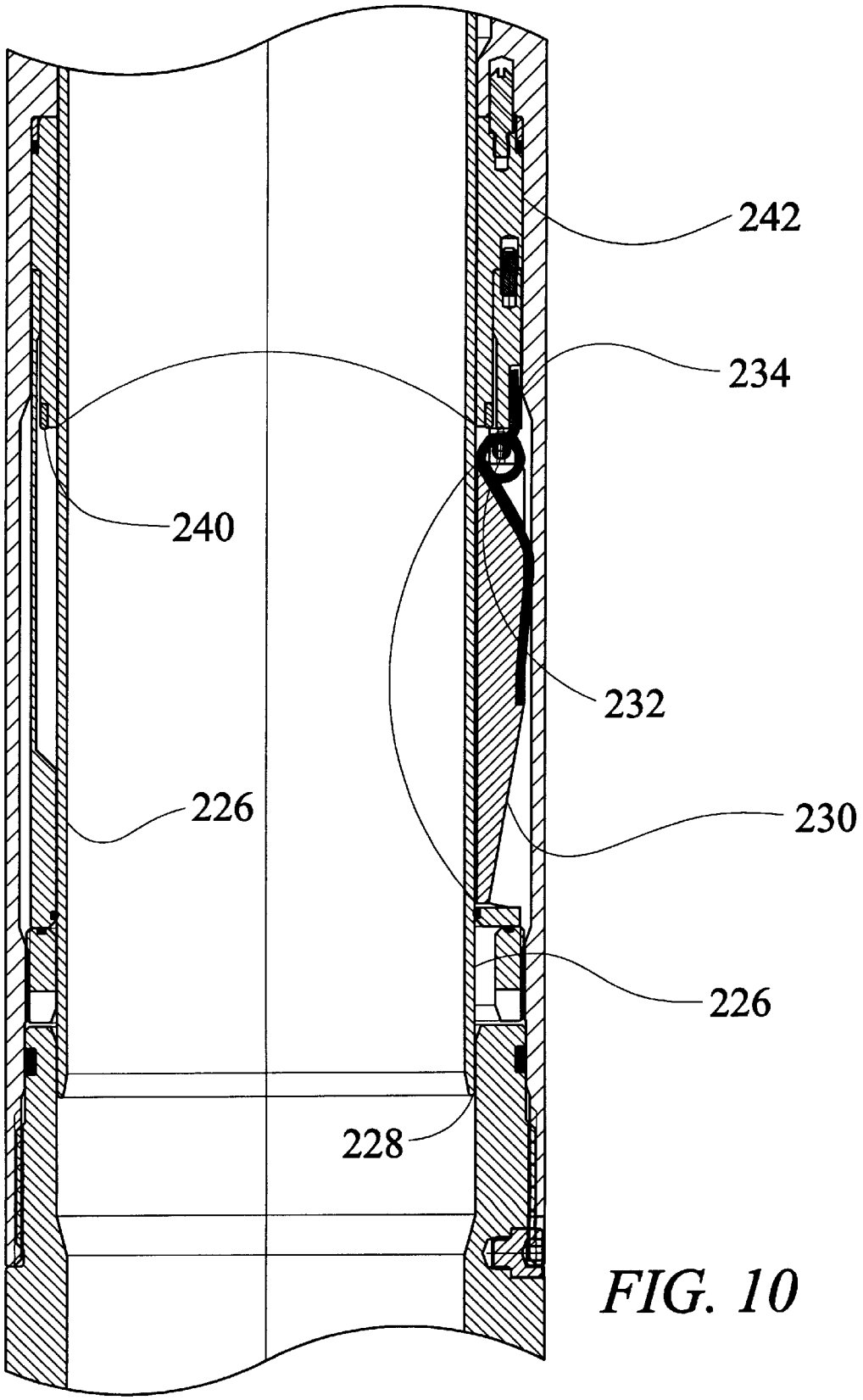
FIG. 10 is an elevational enlarged view, in section, showing the deployment flapper valve open.
Figure 11:
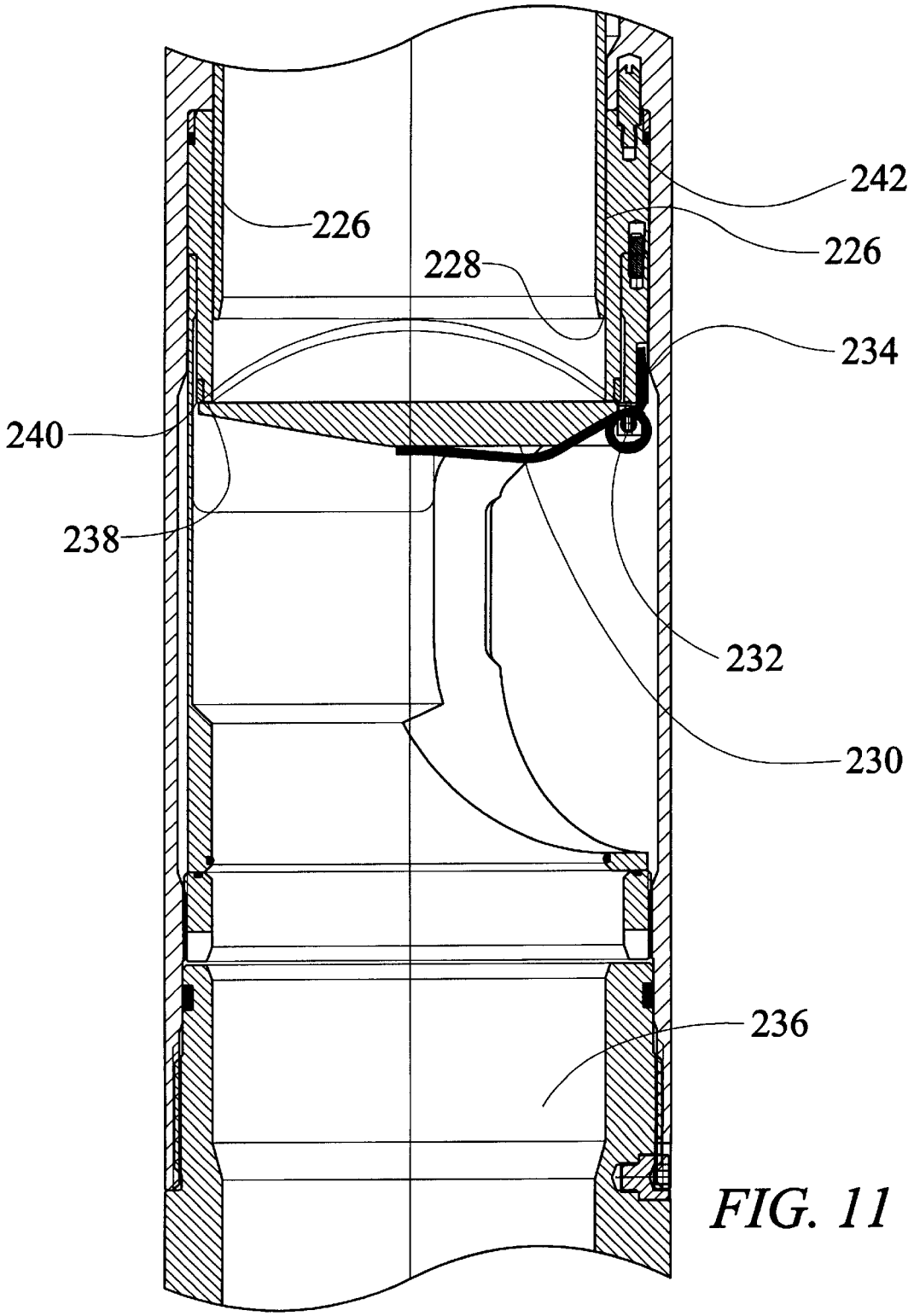
FIG. 11 is an elevational enlarged view, in section, showing the deployment flapper valve closed.

Referring now to valve section 154 in FIGS. 8, 9, 10 and FIG. 11. Upper mandrel 172 is rigidly connected to lower mandrel 220 by threads or other means and moves therewith as one piece. Lower mandrel 220 comprises upper actuator connector 222, upper actuator extension 224, and lower actuator extension 226. Therefore, movement and force are transferred through upper mandrel 172 to lower mandrel 220. Pressure is applied to the annulus or control line and, as explained hereinbefore upper mandrel 172 and hence lower mandrel 220 moves downward. Lower edge 228 (see FIG. 10 or FIG. 11) of lower actuator extension 226 applies a force to the top side of flapper 230. The force creates a moment on flapper 230 that pivots around flapper pin 232, rotating flapper 230 approximately ¼ turn around flapper pin 232 to the open position whereby the full bore of the casing string and/or liner is open for drilling operations. Lower actuator extension 226 is maintained in a downward position as shown for holding flapper 230 in the open position as shown in FIG. 10.

When it is desired for flapper 230 to return to the closed position, the applied pressure is reduced and lower mandrel 220 moves upwardly as explained hereinbefore. Once lower actuator extension 226 is removed from the rotational path of flapper 230, then flapper spring 234 creates a moment acting on flapper 230 pivoting around flapper pin 232 approximately ¼ turn to the closed position as shown in FIG. 1. In the closed position, flapper 230 seals off bore 236 below flapper 230. The seal is achieved by the upper face 238 of flapper 230 acting against lower end 240 of valve seat 242. Seals on the valve seat may include elastomeric seals, metal seals, other types of seals or combinations thereof. FIG. 9 shows a cross-section view of flapper 230 in the closed position looking upwardly from the bottom. It will be noted that at least in this embodiment, flapper 230 is slightly eccentrically positioned such that a center line 231 of bore 236 is slightly off from a center line 233 of flapper 230. While this flapper design is slighlty eccentric, it will be noted that this is not necessarily the case for all embodiments. Inother words, in some embodiments of the invention the flapper may be concentrically positioned with respect to the bore. Once the well is completed and valve operation is no longer desired, upper actuator extension 224 and lower actuator extension 226 can be operated for permanently leaving deployment valve 150 in the open position.

Figure 12:
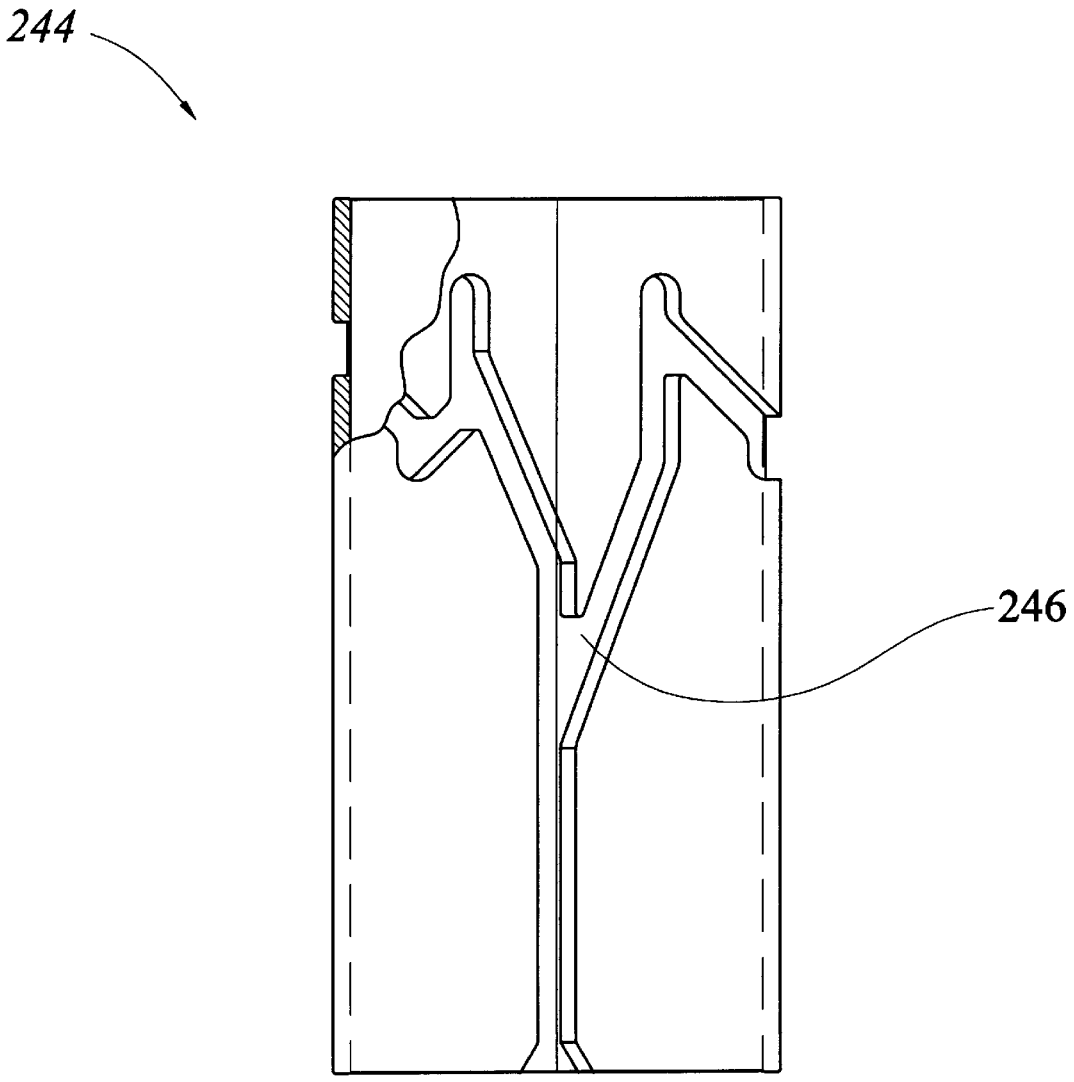
FIG. 12 is an elevational view, partially in section, showing an indexing sleeve for the deployment valve.
Figure 13:
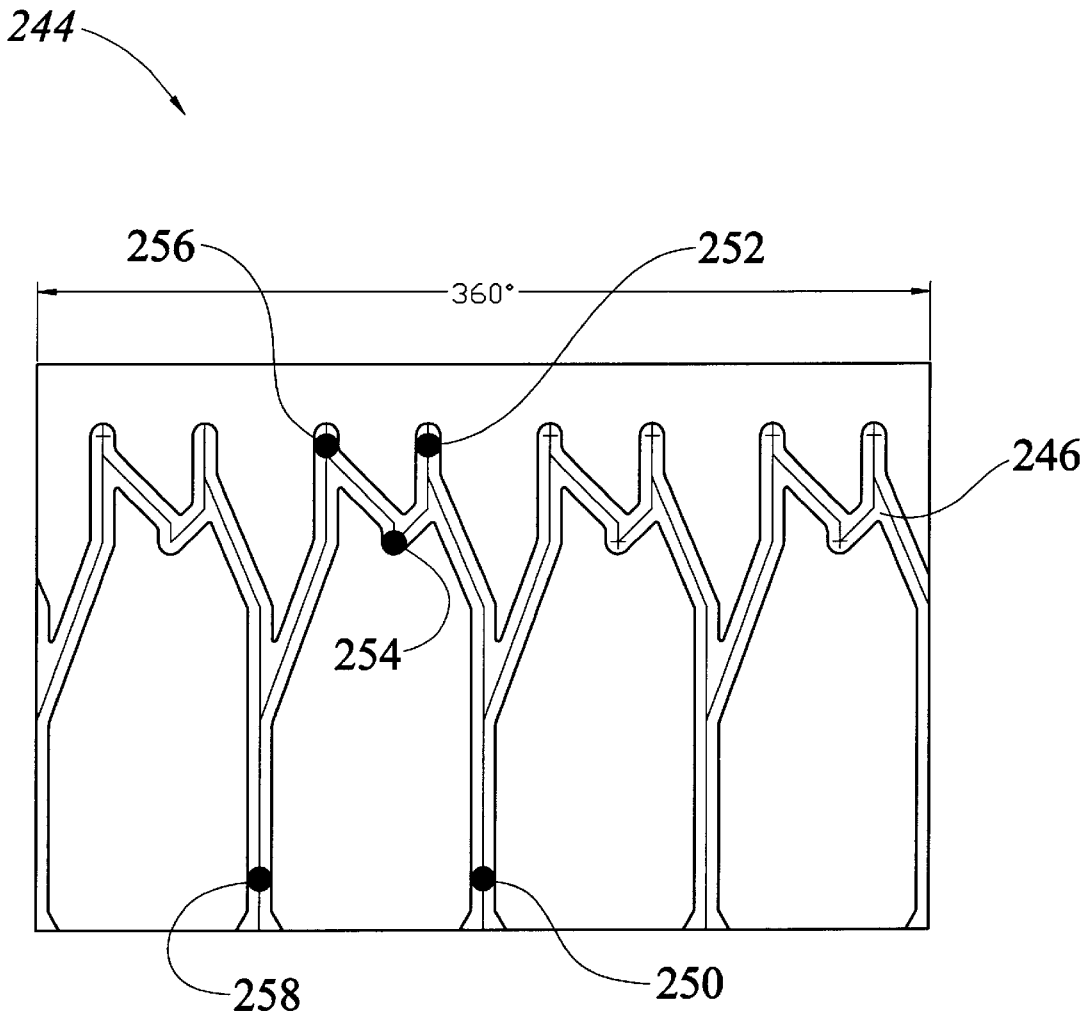
FIG. 13 is an elevational view spread out over 360° showing an indexing slot pattern for the indexing sleeve.

In a presently preferred embodiment of the invention, deployment valve is equipped with indexing sleeve 244 that allows deployment valve 150 to be held in the open position without having applied pressure acting on the tool either through the annulus or the control line. Indexing sleeve 244 is shown in FIG. 7, FIG. 12, and FIG. 13. Indexing sleeve 244 is held on upper mandrel 172 between J-slot mandrel 180 and equalizing send mandrel 176. Indexing sleeve 244 indexes deployment valve 150 by means of slot pattern 246 that is machined into and around the circumference thereof and by a set of J-slot pins 248 mounted to upper housing 188.

Referring to FIG. 13, when pressure is applied to open deployment valve 150, pattern 246 aligns with J-slot pins 248 so that J-slot pins 248 will maintain the valve in the open position with the loss or reduction of surface applied pressure. To close deployment valve 150, applied pressure is reduced and then the pressure is reapplied to move slot pattern 246 to the free travel position allowing indexing sleeve 244 and upper mandrel 172 to move upwardly freely. For instance, with J-slot pin 248 at position 250 in slot pattern 246, deployment valve 150 is closed. Pressure is applied to move J-slot pin 248 to position 252. With J-slot pin 248 at position 252, the deployment valve will be open as long as pressure is applied. However, upon release of pressure, J-slot pin 248 will move to position 254 whereupon deployment valve 150 is locked in the open position even with no applied pressure. To close deployment valve 150, pressure is applied to move J-slot pin 248 to position 256 where the valve remains open so long as pressure is applied. Once pressure is now released, then J-slot pin 248 moves to position 258 and the valve is closed. Thus, indexing sleeve 244 rotates during operation with respect to housing 188. Deployment valve 150 can be cycled through the positions of indexing sleeve as many times as necessary.

While the deployment valve of the present invention is highly suitable for use in underbalanced drilling as explained above, it will be appreciated that the deployment valve may find other uses including drilling even when the well is overbalanced for additional well control, or even non-drilling functions or production type uses. Since changes and modifications may be made in the disclosed embodiment without departing from the inventive concepts involved, it is the aim of this specification, drawings, and appended claims to cover all such changes and modifications falling within the spirit and the scope of the present invention.

What is claimed is:

1. A method for underbalanced drilling a well bore through a well bore formation, a first tubular string being cemented in said wellbore, said first tubular string having a bottom end, a second tubular string for said well bore, a drilling string being moveable through the second tubular string, said method comprising:

providing said second tubular string for placement within said well bore, said second tubular string being an outermost tubular string at well depths below said bottom end of said first tubular string;

mounting a deployment valve within said second tubular string such that at least a portion of said deployment valve is positioned at a well depth above said bottom end of said first tubular string;

cementing said second tubular string at least below said bottom end of said first tubular string within said well bore; and controlling a fluid pressure for opening and closing said deployment valve.

2. The method of claim 1, further comprising:

providing said drill string to be moveable through said second tubular string and said deployment valve when said deployment valve is in an open position, said deployment valve being closeable when said drill string is no longer positioned within said deployment valve.

3. The method of claim 1, further comprising:

extending said drill string through said deployment valve, drilling into a reservoir portion of said well bore formation below said second tubular string.

4. The method of claim 3, further comprising:

pulling said drill string from said reservoir portion into said second tubular string, and closing said deployment valve.

5. The method of claim 4, further comprising:

reducing pressure in said second tubular string above said deployment valve.

6. The method of claim 4, further comprising:

removing said drill string from said well bore.

7. The method of claim 1, further comprising:

introducing said drill string into said second tubular string when said deployment valve is closed.

8. The method of claim 7, further comprising:

pressurizing said second tubular string above said deployment valve.

9. The method of claim 8, further comprising:

opening said deployment valve.

10. The method of claim 9, further comprising:

extending said drill string through said deployment valve.

11. The method of claim 1, further comprising:

mounting said deployment valve on said second tubular string prior to providing said drill string within said well bore.

12. The method of claim 1, further comprising:

mounting said deployment valve on said second tubular string after providing said drill string within said well bore.

13. A deployment valve system for an underbalanced drilling system to form a well bore through a well bore formation with a drilling string, said drilling string having a drill bit and said drill bit having an outer diameter, said drilling string being operable for drilling into a formation reservoir, a first tubular string cemented into said wellbore said first tubular string having a bottom end, said wellbore having a second tubular string therein securable with respect to said well bore formation, said second tubular string below said bottom end of said first tubular string being an outermost tubular string within said well bore, said drilling string being moveable into and out of said second tubular string for drilling into said formation reservoir and having a light point such that upwardly directed forces acting on said drilling string are greater than downwardly acting forces, said deployment valve system comprising:

a deployment valve body positionable in said second tubular string such that at least a portion of said deployment valve body is mounted at a wellbore depth above said bottom end of said first tubular string, said deployment valve comprising, said deployment valve body having a valve body outer diameter no greater than ten percent larger of an outer diameter of any adjacent tubular elements of said second tubular sting;

a deployment valve element within said deployment valve body being moveable from an open position to a closed position; and a seal for said deployment valve such that said deployment valve is closeable with said seal therein for controlling a pressure below said deployment valve.

14. The deployment valve system of claim 13, further comprising:

a rotating blowout preventer for sealing around said drilling string to contain pressure external to said drilling string.

15. The deployment valve system of claim 13, further comprising:

said deployment valve element being one or more flapper valve elements moveable within said deployment valve, and one or more pivot connections to secure said one or more flapper valve elements to said deployment valve such that said one or more flapper valve elements are moveable between said open position and said closed position.

16. The deployment valve system of claim 13, further comprising:

at least one hydraulic line for controlling movement of said deployment valve element.

17. The deployment valve system of claim 13, further comprising:

an annular control system for controlling movement of said deployment valve element.

18. The deployment valve system of claim 13, further comprising:

said deployment valve body being openable to permit said drill bit to pass through said bore.

19. A method for underbalanced drilling of a well bore through a reservoir formation with a drilling string, a first tubular string being cemented into said well bore, said first tubular string having a bottom end, a second tubular string secured within said well bore wherein at least a portion of said second tubular string below said bottom end of said first tubular string is cemented into said well bore said second tubular string below said bottom end of said first tubular string being an outermost tubular string, said drilling string being operable for drilling into open hole at a well bore depth below said second tubular string, said method comprising:

positioning a deployment valve within said second tubular string such that at least a portion or said deployment valve is positioned at a well depth above said bottom end of said first tubular string;

controlling a fluid pressure for opening and closing said deployment valve;

moving said drilling String through said second tubular string and said deployment valve;

drilling open hole below said second tubular string;

pulling said drilling string back into said second tubular string from said open hole; and closing said deployment valve.

20. The method of claim 19, further comprising:

controlling a pressure at a well depth below said deployment valve by said step of closing said deployment valve, and bleeding off a tubular string pressure within said second tubular string at a well depth above said deployment valve.

21. The method of claim 19, further comprising:

opening said second tubular string to atmospheric pressure, and removing said drilling string from said second tubular string.

22. The method of claim 19, further comprising:

reinserting said drilling string into said second tubular string.

23. The method of claim 19, further comprising:

positioning said deployment valve within said second tubular string at or below a depth at which forces acting upwardly on said drilling string are greater than forces acting downwardly on said drilling string.

24. A deployment valve system for an underbalanced drilling system to form a well bore through a well bore formation with a drilling string, said drilling string having a drill bit and said drill bit having an outer diameter, said drilling string being operable for drilling into a formation reservoir, said wellbore having a first tubular string therein secured with respect to said well bore formation by cementing said first tubular string in position, said first tubular string having a bottom end, said wellbore having a second tubular string secured therein such that at least a portion of said second tubular string below said bottom end of said first tubular string is cemented in position, said second tubular string below said bottom end of said first tubular string being an outermost tubular string with respect to said wellbore, said drilling string being moveable into and out of said second tubular string for drilling into said formation reservoir and having a string light point such that upwardly acting forces on said drilling string are greater than downwardly acting forces, said deployment valve system comprising:

a deployment valve positionable in said second tubular string such that at least a portion of said deployment valve is mounted at a wellbore depth adjacent said bottom end of said first tubular string, said deployment valve comprising:

a deployment valve element within said second deployment valve being moveable from an open position to a closed position in response to fluid pressure, said deployment valve in said open position having a passage therethrough sufficient to permit said drill bit to pass through said deployment valve, and a seal for said deployment valve such that said deployment valve is closeable with said seal therein for controlling a pressure below said deployment valve.

25. The deployment valve system of claim 24, further comprising:

a rotating blowout preventer for sealing around said drilling string as said drilling string moves.

26. The deployment valve system of claim 25, further comprising:

said deployment valve element being one or more flapper valve elements moveable within said deployment valve, and one or more pivot connections to secure said one or more flapper valve elements to said deployment valve such that said one or more flapper valve elements are moveable between said open position and said closed position.

27. The deployment valve system of claim 24, further comprising:

said deployment valve being mounted adjacently above said formation reservoir.

28. The deployment valve system of claim 24, further comprising:

a deployment valve positionable in said second tubular string such that it is mounted at or below a wellbore depth at which said upwardly acting forces on said drilling string are greater than said downwardly acting forces.

29. A deployment valve system for use in a wellbore, comprising:

deployment valve being mountable within said wellbore said wellbore having a first wellbore tubular cemented into said wellbore, said first wellbore tubular having a bottom end, said deployment valve being mountable in a second wellbore tubular as a tabular section thereof, said second wellbore tubular being run into said wellbore to a wellbore depth below said bottom end of said first wellbore tubular and being cemented into position within said wellbore such that said deployment valve is mountable at a subterranean position in said well bore adjacent said bottom end of said first wellbore tubular, said second wellbore tubular having a bore therethrough, a drill string with a drill bit for drilling through said second tubular;

a tubular body having an opening therethrough at least as large as said bore of said wellbore tubular; and a valve element mounted within said tubular body, said valve element being moveable for opening and closing said wellbore tubular in response to a control pressure, said valve element being controllable for opening said wellbore tubular to allow said drill bit and said drill string to pass therethrough, said valve element being controllable for closing and sealing said wellbore tubular after said drill bit and said drill string are pulled above a position in said wellbore tubular at which said valve element is positioned.

30. The deployment valve system of claim 29, further comprising:

a flapper valve for said valve element.

31. The deployment valve system of claim 29, further comprising;

a return force element mounted within said deployment valve for producing a return force for said valve element.

32. The deployment valve system of claim 31, further comprising:

a pressurized chamber with a piston therein, said piston being moveable upon release of said control pressure for controlling closing of said valve element.

33. The deployment valve system of claim 29, further comprising:

a plurality of annular pistons moveable within said tubular housing.

34. The deployment valve system of claim 29, further comprising:

an outer diameter of said tubular body being no more than about ten percent of an outer diameter of any said wellbore tubular adjacent said tubular body.

35. The deployment valve system of claim 29, wherein:

said control pressure is annularly applied.

36. The deployment valve system of claim 29, wherein:

said control pressure is applied from a control line.

37. The deployment valve of system claim 29, further comprising:

an indexing sleeve for controlling movement of said valve element in accordance with an indexing pattern.

* * * * *